US005666465A

United States Patent [19]

Ozawa

[11] Patent Number: 5,666,465

[45] Date of Patent: Sep. 9, 1997

[54] SPEECH PARAMETER ENCODER

[75] Inventor: Kazunori Ozawa, Tokyo, Japan

[73] Assignee: NEC Corporation, Tokyo, Japan

[21] Appl. No.: 355,295

[22] Filed: Dec. 12, 1994

[30] Foreign Application Priority Data

Dec. 10, 1993 [JP] Japan ..... 5-310524

[51] Int. Cl.[6] ..... G10L 3/02; G10L 9/00

[52] U.S. Cl. ..... 704/222; 704/230

[58] Field of Search ..... 395/2.38, 2.39, 395/2.29–2.31; 381/36, 40

[56] References Cited

U.S. PATENT DOCUMENTS

| | | | |
|---|---|---|---|
| 4,716,592 | 12/1987 | Ozawa et al. | 381/40 |
| 4,969,192 | 11/1990 | Chen et al. | 381/31 |
| 4,972,484 | 11/1990 | Theile et al. | 381/37 |
| 5,208,862 | 5/1993 | Ozawa | 381/36 |
| 5,487,086 | 1/1996 | Bhaskar | 381/36 |
| 5,487,128 | 1/1996 | Ozawa | 395/2.31 |

OTHER PUBLICATIONS

Sugamura et al., "Quantizer Design in LSP Speech Analysis–Synthesis", IEEE Journal, vol. 6, No. 2, Feb. 1988, pp. 432–440.

Johnston et al., "Transform Coding of Audio Signals using Perceptual Noise Criteria", IEEE J. Sel. Areas in Commun., Feb. 1988, pp. 314–323.

Hans Strube, "Linear Prediction on a Wrapped Frequency Scale", J. Acoust. Soc. Am., vol. 68, No. 4, Oct. 1980, pp. 1071–1076.

Zwicker et al., "Psychoacoustics", Springer–Verlag, (1990), pp. 141–147.

Robert M. Gray, "Vector Quantization", IEEEE ASAP Mag., Apr. 1984, pp. 4–29.

T. Moriya et al., "Transform Coding of Speech Using a Weighted Vector Quantizer", IEEE Journal on Selected Areas in Communications, vol. 6, No. 2, Feb. 1988, pp. 425–431.

Y. Linde et al., "An Algorithm for Vector Quantizer Design", IEEE Transactions on Communications, vol. Com–28, No. 1, Jan. 1980, pp. 84–95.

K. Paliwal et al., "Efficient Vector Quantization of LPC Parameters at 24 Bits/Frame", IEEE Transactions on Speech and Audio Processing, vol. 1, No. 1, Jan. 1993, pp. 3–14.

*Primary Examiner*—Allen R. MacDonald
*Assistant Examiner*—Patrick N. Edouard
*Attorney, Agent, or Firm*—Foley & Lardner

[57] ABSTRACT

A speech parameter encoder capable of encoding spectrum parameters at a bit rate of 1 kb/s or less with comparatively small amount of operations and memory capacity. A spectrum parameter calculation unit 130 derives a spectrum parameter representing the spectrum envelope of a discrete input speech signal through division thereof into frames each having a predetermined time length. A weighted coefficient calculation unit 150 derives a weighted coefficient corresponding to an auditory masking threshold value through derivation thereof from the speech signal. A spectrum parameter quantization unit 160 receives the weighted coefficient and the spectrum parameter and quantizes the spectrum parameter through search of a codebook such as to minimize the weighting distortion based on the weighted coefficient.

7 Claims, 5 Drawing Sheets

SPEECH PARAMETER ENCODER

BACKGROUND OF THE INVENTION

The present invention relates to speech parameter encoders for high quality speech signal spectrum parameter encoding at low bit rates.

As speech parameter encoding, i.e., encoding of speech signal spectrum parameters at as low a bit rate as 2 kb/s, there has been known VQ-SQ: vector-scalar quantization method using LSP (Line Spectrum Pair) coefficients as spectrum parameters. As for a specific method, it is possible to refer to, for instance, T. Moriya et al "Transform Coding of Speech using a Weighted Vector Quantizer", IEEE J. Sel. Areas, Commun., pp. 425–431, 1988 (Literature 1). In this method, an LSP coefficient obtained as a spectrum parameter for each frame is once quantized and decoded with a previously formed vector quantization codebook, and then an error signal between the original LSP and the quantized decoded LSP is scalar-quantized. As the vector quantization codebook, a codebook is preliminarily formed by training with respect to a large quantity of spectrum parameter data bases such that it comprises $2^B$ (B being the number of kits for spectrum parameter quantization) different codevectors. As for the training method of codebook, it is possible to refer to, for instance, Linde et al., "An Algorithm for Vector Quantization Design", IEEE Trans. COM-28, pp. 84–95, 1980 (Literature 2).

Further, as a more efficient well-known encoding method, there is a split vector quantization method, in which the dimensions (for instance 10 dimensions) of the LSP parameter is divided into a plurality of divisions (each of 5 dimensions, for instance), and a vector quantization codebook is searched for the quantization for each division. For the details of this method, it is possible to refer to, for instance, K. K. Paliwal et al., "Efficient Vector Quantization of LPC Parameters at 24 Bits/Frame", IEEE Trans. Speech and Audio Processing, pp. 3–14, 1993 (Literature 3).

In order to reduce the bit rate of the spectrum parameter encoding to be 1 kb/s or less, it is required to reduce the spectrum parameter quantization bit number to 20 bits per frame (with a frame length of 20 ms) or less while holding the distortion due to the spectrum parameter quantization to be within the perceptual limit of auditory sense. In the prior art methods, it has been difficult to do so because of the lack of reflection of auditory sense characteristics by the distortion measure, thus leading to great speech quality deterioration with reduction of the quantization bit number to 20 or less.

SUMMARY OF THE INVENTION

It is an object of the present invention to provide a speech parameter encoder capable of solving the above problems and encoding spectrum parameters at a bit rate of 1 kb/s or less with comparatively small amount of operations and memory capacity.

According to the present invention, there is provided a speech parameter encoder comprising: a spectrum parameter calculation unit for deriving a spectrum parameter representing the spectrum envelope of a discrete input speech signal through division thereof into frames each having a predetermined time length, a weighted coefficient calculation unit for deriving a weighted coefficient corresponding to an auditory masking threshold value through derivation thereof from the speech signal, and a spectrum parameter quantization unit for receiving the weighted coefficient and the spectrum parameter and quantizing the spectrum parameter through search of a codebook such as to minimize the weighting distortion based on the weighted coefficient.

Other objects and features will be clarified from the following description with reference to attached drawings.

DETAILED DESCRIPTION OF THE PREFERRED EMBODIMENTS

Figure 1:
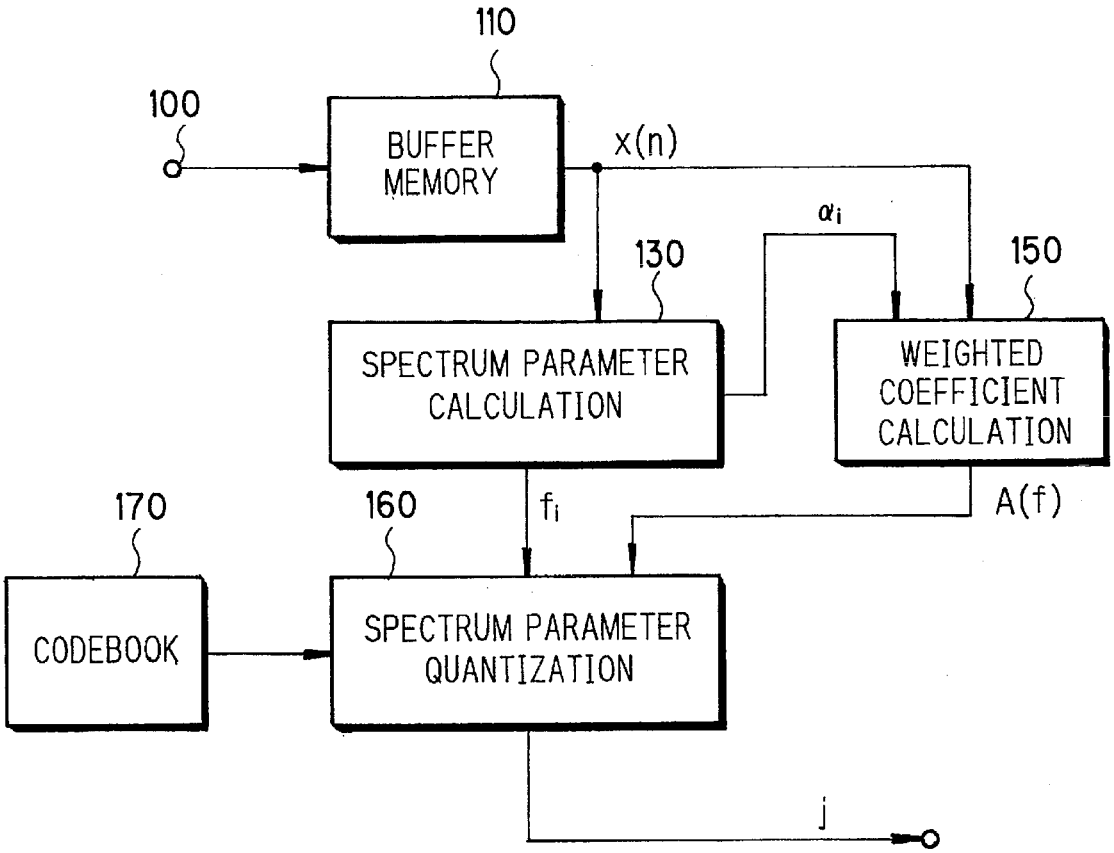
FIG. 1 is a block diagram showing a first embodiment of the speech parameter encoder according to the present invention.

The speech parameter encoder according to an embodiment of the present invention will now be described. In the following description, it is assumed that LSP is used as the spectrum parameter. However, it is possible to use other well-known parameters as well, for instance PARCOR, cepstrum, Mel cepstrum, and etc. As for the way of deriving LSP, it is possible to refer to Sugamura et al., "Quantizer design in LSP speech analysis-synthesis", IEEE J. Sel. Areas, Commun., pp. 432–440, 1988 (Literature 4).

A speech signal is divided into frames (of 20 ms, for instance), and LSP is derived in the spectrum parameter calculation unit. Further, the weighted coefficient calculation unit derives auditory masking threshold value from the speech signal for a frame and derives a weighted coefficient from such value data. Specifically, a power spectrum is derived through the Fourier transform of the speech signal, and a power sum is derived with respect to the power spectrum for each critical band. As for the lower and upper limit frequencies of each critical band, it is possible to refer to E. Zwicker et al., "Psychoacoustics", Springer-Verlag, 1990 (referred to here as Literature 5). Then, the unit calculates a spreading spectrum through convolution of a spreading function on critical band power. Then, it calculates a masking threshold value spectrum $P_{mi}$ (i=1, . . . , B, B being the number of critical bands) through compensation of the spreading spectrum by a predetermined threshold value for each critical band. As for specific examples of the spreading function and threshold value, it is possible to refer to J. Johnston et al., "Transform coding of Audio Signals using Perceptual Noise Criteria", IEEE J. Sel. Areas in Commun., pp. 314–323, 1988 (referred to here as Literature 6). Transform of $P_{mi}$ into linear frequency axis is made to be output as weighted coefficient A(f).

The spectrum parameter quantization unit quantizes the spectrum parameter such as to minimize the weighting quantization distortion of formula (1).

$$D_j = \sum_{i=1}^{M} [A(f_i)(f_i - f_{ij})]^2 \tag{1}$$

Here, $f_i$ and $f_{ij}$ are respectively the i-degree input LSP parameter and the j-degree codevector in a spectrum parameter codebook of a predetermined number of bits, M is the degree of the spectrum parameter, and $A(f_i)$ is the weighted coefficient which can be expressed by, for instance, formula (2).

$$A(f_i) = Q/P_m(f_i) \quad (2)$$

$$Q = \sum_{i=1}^{M} [1/P_m(f_i)] \quad (3)$$

A spectrum parameter codebook is designed in advance by using the method shown in Literature 2.

The weighted coefficient calculation unit according to the present invention, in deriving the masking threshold value, instead of the deriving the power spectrum through the Fourier transform of speech signal, may derive the power spectrum envelope through the Fourier transform of the spectrum parameter (for instance linear prediction coefficient), thereby deriving the masking threshold value from the power spectrum envelope by the above method and then deriving the weighted coefficient.

Further, in the spectrum parameter calculation unit according to the present invention, it is possible to perform the linear transform of the spectrum parameter such as to meet auditory sense characteristics before the quantization of spectrum parameter in the above way. As for the auditory sense characteristics, it is well known that the frequency axis is non-linear and that the resolution is higher for lower bands and higher for higher bands. Among well-known methods of non-linear transform which meets such characteristics is the Mel transform. As for the Mel transform of spectrum parameter, the transform from a power spectrum and the transform from an auto-correlation function are well known. For the details of these methods, it is possible to refer to, for instance, Strube et al., "Linear prediction on a warped frequency scale", J. Acoust. Soc. Am., pp. 1071–1076, 1980 (Literature 7).

Further, it is well known to perform a direct Mel transform of LSP coefficient. With respect to the LSP having been Mel transformed, the quantization of spectrum parameter is performed by applying formulae (1) to (3). Here, with respect to the non-linearly transformed LSP, a vector quantization codebook is formed by training in advance. For the way of forming the vector quantization codebook, it is possible to refer to Literature 2 noted above.

FIG. 1 is a block diagram showing a first embodiment of the speech parameter encoder according to the present invention. Referring to FIG. 1, on the transmitting side, a speech signal input to an input terminal 100 is stored for one frame (of 20 ms, for instance) in a buffer memory 110.

A spectrum parameter calculation unit 130 calculates linear prediction coefficients $\alpha_i$ (i=1, . . . , M, M being the degree of prediction) for a predetermined degree P as parameters representing spectrum characteristics of the frame speech signal X(n) through well-known LPC analysis thereof. Further, it performs the transform of the linear prediction coefficient into an LSP parameter $f_i$ according to Literature 4.

Figure 2:
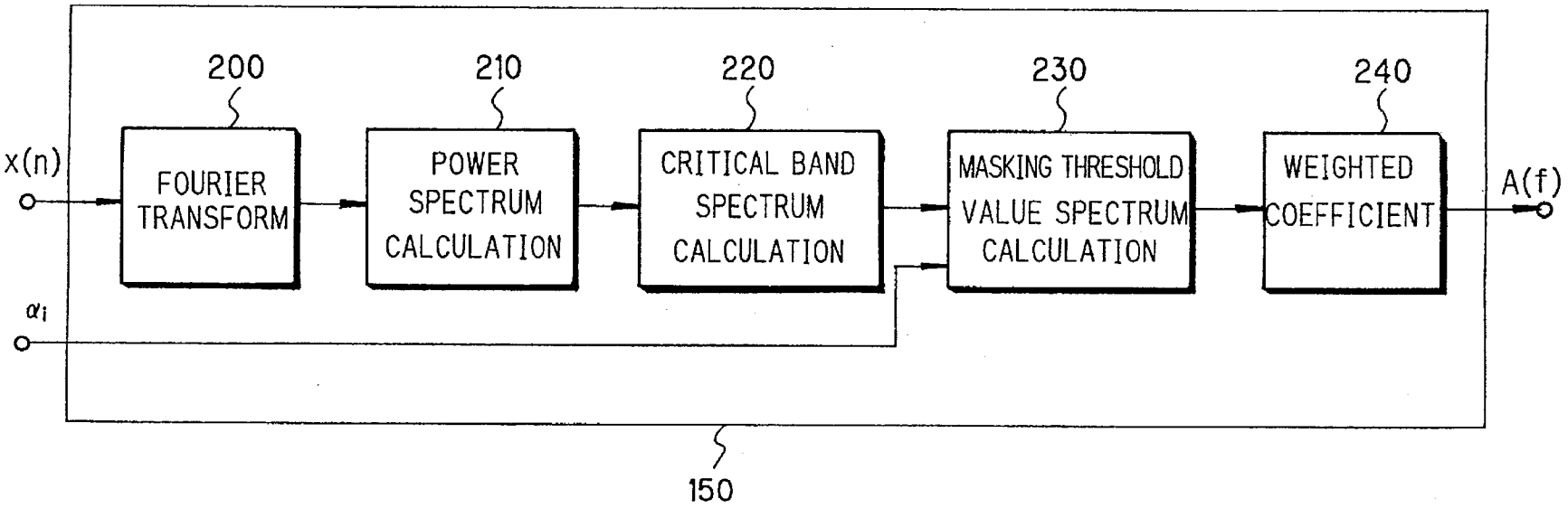
FIG. 2 shows a structure of the weighted coefficient calculation unit 150 in FIG. 1.

The weighted coefficient calculation unit 150 derives an auditory masking threshold value from the speech signal and further derives a weighted coefficient. FIG. 2 shows the structure of the weighted coefficient calculation unit 150.

Referring to FIG. 2, a Fourier transform unit 200 receives the frame speech signal and performs a Fourier transform thereof at predetermined number of points through the multiplication of the input with a predetermined window function (for instance, a Hamming window). A power spectrum calculation unit 210 calculates a power spectrum P(w) for the output of the Fourier transform unit 200 based on formula (4).

$$P(w)=Re[X(w)]^2+Im[X(w)]^2 \quad (4)$$

$$(w=0 \ldots \pi)$$

Here, Re [X(w)] and Im [X(w)] are real and imaginary parts, respectively, of the spectrum as a result of the Fourier transform, and w is the angular frequency. A critical band spectrum calculation unit 220 performs calculation of formula (5) by using P(w).

$$Bi = \sum_{w=bl_i}^{bh_i} P(w) \quad (5)$$

Here, $B_i$ is the critical band spectrum of the i-th band, and $bl_i$ and $bh_i$ are the lower and upper limit frequencies, respectively, of the i-th critical band. For specific frequencies, it is possible to refer to Literature 5.

Subsequently, convolution of a spreading function on each critical band spectrum is performed based on formula (6).

$$C_i = \sum_{j=1}^{b_{max}} B_j sprd(j,i) \quad (6)$$

Here, sprd (j, i) is the spreading function, for specific values of which it is possible to refer to Literature 4, and $b_{max}$ is the number of critical bands that are included up to angular frequency. The critical band spectrum calculation unit 220 provides output $C_i$.

A masking threshold value spectrum calculation unit 230 calculates masking threshold value spectrum $Th_i$ based on formula (7).

$$Th_i=C_iT_i \quad (7)$$

Here, $$T_i = 10^{-(O_i/10)} \quad (8)$$

$$O^i = \alpha(14.5 + i) + (1 - \alpha)5.5 \quad (9)$$

$$\alpha = \min[N(NG/R),1.0] \quad (10)$$

$$NG = 10 \log_{10} \prod_{i=1}^{M} [1 - k_i^2] \quad (11)$$

Here, $k_i$ is K parameter of the i-degree to be derived from the input linear prediction coefficient in a well-known method, M is the degree of linear prediction analysis, and R is a predetermined constant.

The masking threshold value spectrum, from the consideration of the absolute threshold value, is as shown by formula (12).

$$Th_i'=\max[Th_i, absth_i] \quad (12)$$

Here, $absth_i$ is the absolute threshold value in the i-th critical band, for which it is possible to refer to Literature 5.

A weighted coefficient unit 240 derives spectrum $P_m(f)$ with transform of the frequency axis from Burke axis to Hertz axis with respect to masking threshold value spectrum Th·i (i=1, . . . , $b_{max}$), and then derives and supplies weighted coefficient A(f) based on formulas (2) and (3).

Referring back to FIG. 1, the spectrum parameter quantization unit 160 receives LSP coefficient $f_i$ and weighted coefficient A(f) from the spectrum parameter and weighted calculation units 130 and 150, respectively, and supplies the index j of the codevector for minimizing the degree of the weighted distortion based on formula (1) through the search of codebook 170. In the codebook 170 are stored predetermined kinds (i.e., $2^B$ kinds, B being the bit number of the codebook) of LSP parameter codevectors $f_i$.

Figure 3:
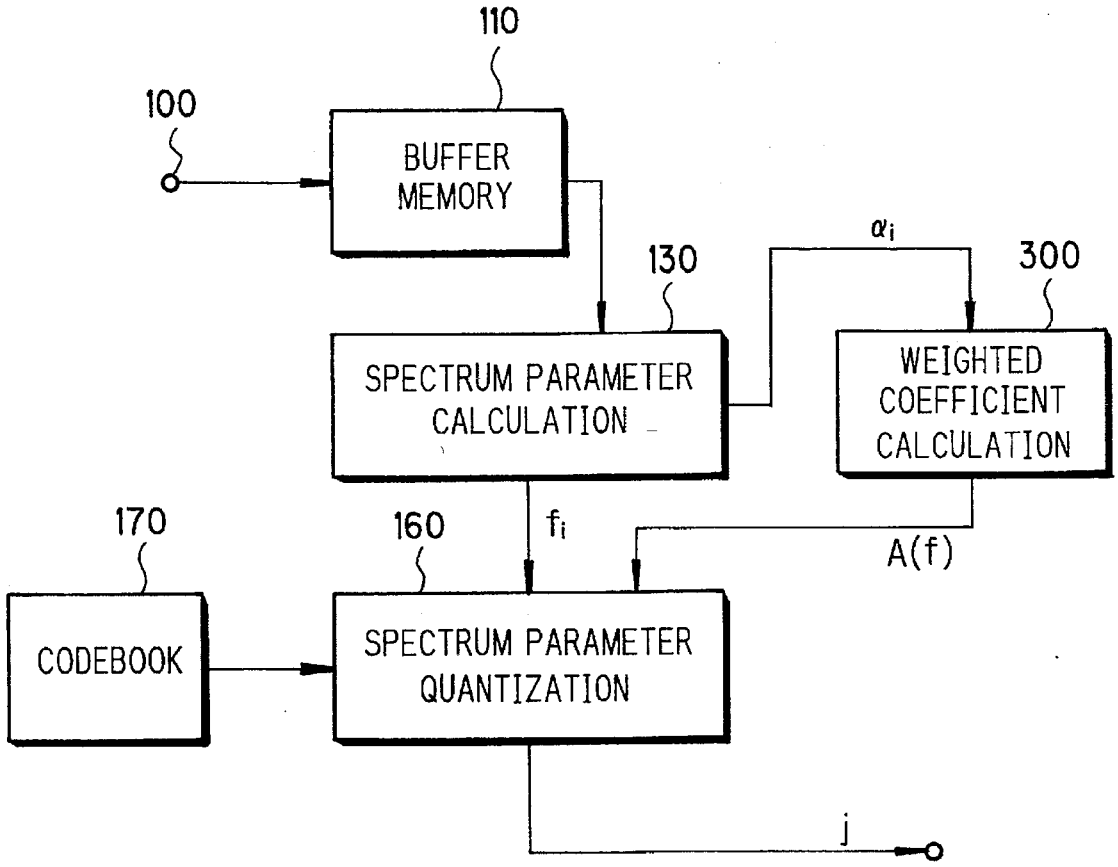
FIG. 3 is a block diagram showing a second embodiment of the present invention.

FIG. 3 is a block diagram showing a second embodiment of the present invention. In FIG. 3, elements designated by reference numerals like those in FIG. 1 operate in the same way as those, so they are not described. This embodiment is different from the embodiment of FIG. 1 in a weighted coefficient calculation unit 300.

Figure 4:
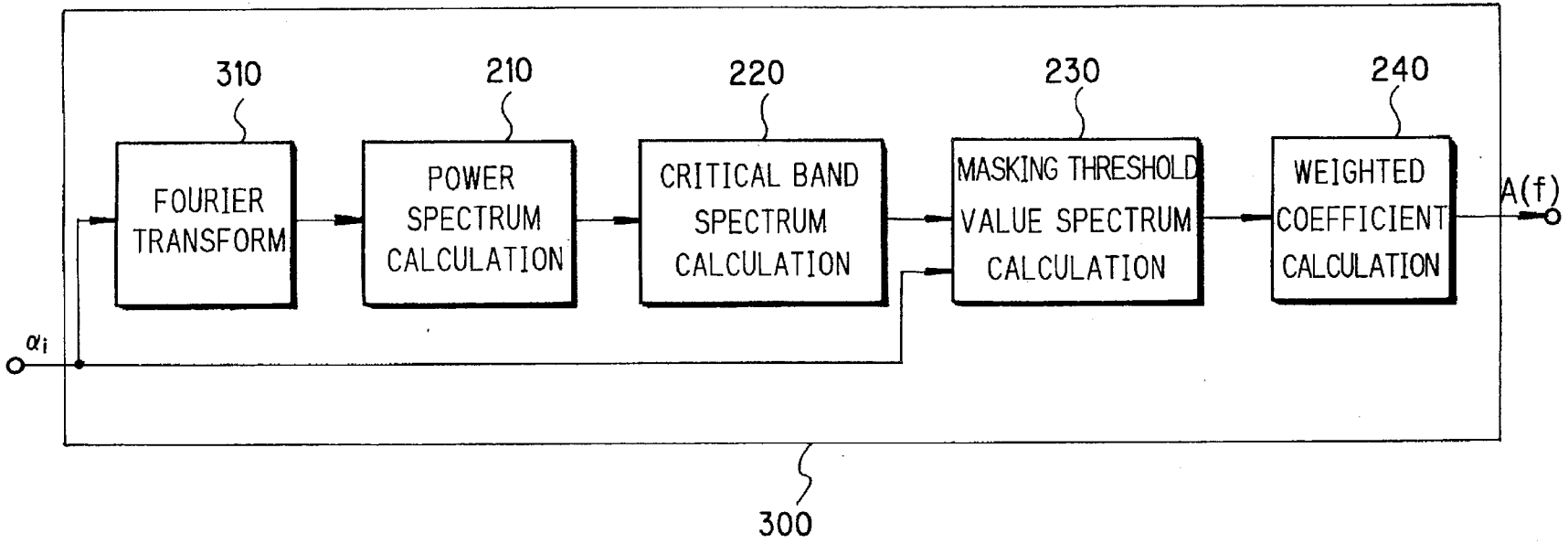
FIG. 4 shows a structure of the weighted coefficient calculation unit 300 in FIG. 3.

FIG. 4 shows the weighted coefficient calculation unit 300. Referring to FIG. 4, a Fourier transform unit 310 performs Fourier transform not of the speech signal x(n) but of a spectrum parameter (here non-linear prediction coefficient $\alpha_i$).

Figure 5:
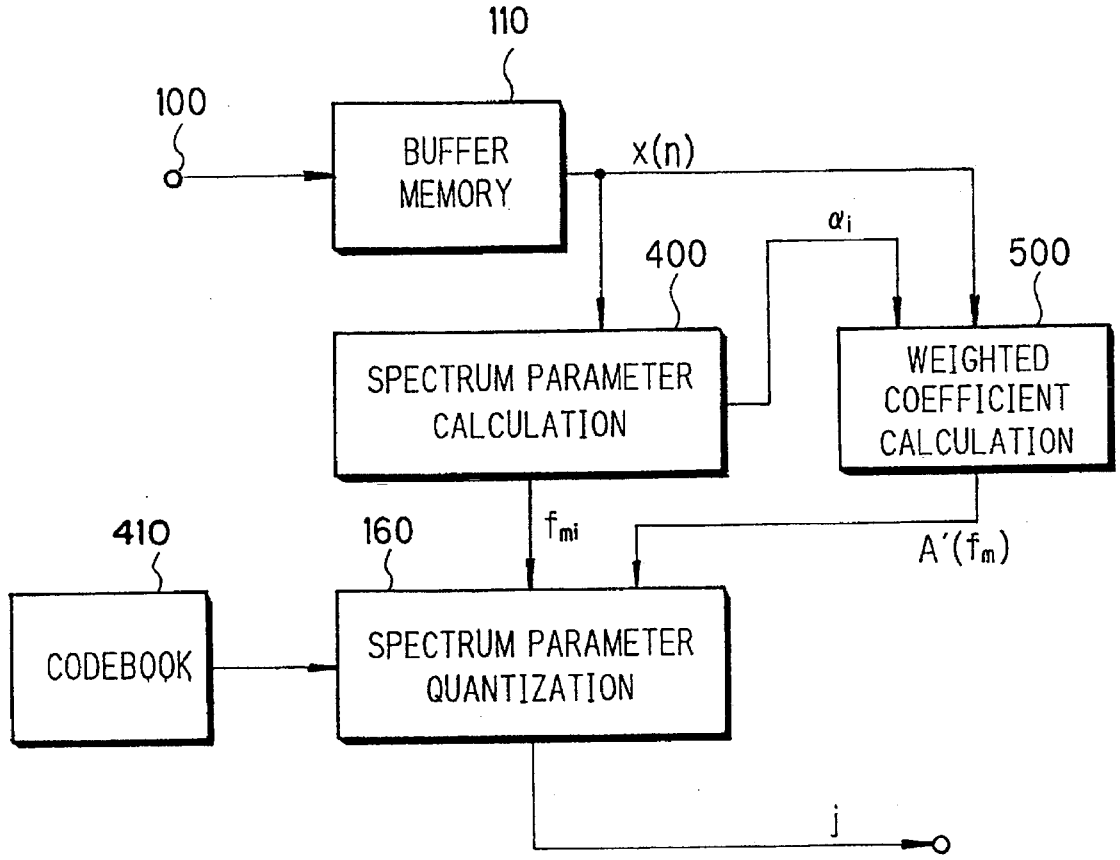
FIG. 5 is a block diagram showing a third embodiment of the present invention.

FIG. 5 is a block diagram showing a third embodiment of the present invention. In the spectrum parameter calculation unit diagram, elements designated by reference numerals like those in FIG. 1 operate in the same way as those, so they are not described. This embodiment is different from the embodiment of FIG. 1 in a spectrum parameter calculation unit 400, a weighted coefficient calculation unit 500 and a codebook 410.

The spectrum parameter calculation unit 400 derives LSP parameters through the non-linear transform of LSP parameter such as to be in conformity to auditory sense characteristics. Here, Mel transform is used as non-linear transform, and Mel LSP parameter $f_{mi}$ and linear Prediction coefficient $\alpha_i$ are provided.

A weighted coefficient calculation unit 500 derives weighted coefficients from the masking threshold value spectrum Th·i (i=1, . . . , $b_{max}$). At this time, it derives spectrum $P'_m(f_m)$ through the transform of the frequency axis from Burke axis to Hertz axis, and it derives and supplies weighted coefficient $A'(f_m)$ by substituting this spectrum into formulae (2) and (3).

The weighted coefficient calculation unit 500 may perform Fourier transform not of the speech signal x(n) but of the linear prediction coefficient $\alpha_i$. In the codebook 410, a codebook is designed in advance through studying with respect to Mel transform LSP.

In the above embodiments, it is possible to use more efficient methods for the LSP parameter quantization, for instance, such well-known methods as a multi-stage vector quantization method, a split vector quantization method in Literature 3, a method in which the vector quantization is performed after prediction from the past quantized LSP sequence, and so forth. Further, it is possible to adopt matrix quantization, Trellis quantization, finite state vector quantization, etc. For the details of these quantization methods, it is possible to refer to Gray et al., "Vector quantization", IEEE ASSP Mag., pp. 4–29, 1984 (Literature 8). Further, it is possible to use other well-known parameters as the spectrum parameter to be quantized, such as K parameter, cepstrum, Mel cepstrum, etc. Further, for the non-linear transform representing auditory sense characteristics, it is possible to use other transform methods as well, for instance Burke transform. For details, it is possible to refer to Literature 5. Further, for the masking threshold value spectrum calculation, it is possible to use other well-known methods as well. In the weighted coefficient calculation unit, it is possible to use a band division filter group instead of the Fourier transform for reducing the amount of operations. Further, it is well known that the auditory sense is more sensitive to frequency error at lower frequencies and less sensitive at higher frequencies. On the basis of this fact, it is possible to the weighting distortion degree of formula (13) in the LSP codebook search.

$$D_j = \sum_{i=1}^{M} [A(f_i)B(f_i)(f_i - f_{ij})]^2 \tag{13}$$

$$B(f_i) = \begin{cases} 1.0 & (f_i < 500\text{ Hz}) \\ 1/[0.002 f_i] & (f_i \geqq 500\text{ Hz}) \end{cases} \tag{14}$$

As has been described in the foregoing, according to the present invention for the quantizing spectrum parameter of speech signal, a weighted coefficient is derived according to the auditory masking threshold value, and the quantization is performed such as to minimize the weighting distortion degree. Thus, distortion is less noticeable by the ears, and it is possible to obtain spectrum parameter quantization at lower bit rates than in the prior art.

Further, according to the present invention quantization with the weighting distortion degree is obtainable after non-linear transform of spectrum parameter such as to be in conformity to auditory sense characteristics, thus permitting further bit rate reduction.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

What is claimed is:

1. A speech parameter encoder comprising:

a spectrum parameter calculation unit for deriving a spectrum parameter representing spectrum envelope of a discrete input speech signal through division thereof into frames each having a predetermined time length;

a weighted coefficient calculation unit for deriving a weighted coefficient derived from an auditory masking threshold value calculated through a linear transformation and a critical band spectrum for the speech signal; and a spectrum parameter quantization unit for receiving the weighted coefficient and the spectrum parameter and quantizing the spectrum parameter through search of a codebook to minimize the weighting distortion based on the weighted coefficient.

2. The speech parameter encoder according to claim 1, wherein said weighted coefficient calculation unit derives a weighted coefficient from an auditory masking threshold value calculated through the linear transformation and the critical band spectrum for the spectrum parameter.

3. The speech parameter encoder according to claim 1, wherein said spectrum parameter calculation unit makes a non-linear transform of the spectrum parameter to meet auditory characteristics.

4. The speech parameter encoder according to claim 2, wherein the spectrum parameter calculation unit makes a non-linear transform of the spectrum parameter to meet auditory characteristics.

5. The speech parameter encoder according to claim 1, wherein said spectrum parameter calculation unit performs a linear transform of the spectrum parameter to meet auditory sense characteristics before the quantization of the spectrum parameter.

6. A speech parameter encoder comprising:

a buffer memory configured to receive a digitized speech signal and to store one frame of the speech signal, the one frame corresponding to a predetermined time length;

a spectrum parameter calculation unit coupled to the buffer memory and configured to read the digitized speech signal in the one frame, to calculate linear prediction coefficients for a predetermined degree as parameters representing spectrum characteristics of the speech signal, and to perform a transform of the linear prediction coefficients into a spectrum parameter;

a weighted coefficient calculation unit coupled to the spectrum parameter calculation unit and the buffer memory, the weighted coefficient calculation unit configured to derive an auditory masking threshold value from the speech signal and to derive a weighted coefficient from the derived auditory masking threshold value;

a codebook for storing a plurality of code vectors; and a spectrum parameter quantization unit coupled to the codebook, the weighted coefficient calculation unit and the spectrum parameter calculation unit, the spectrum parameter quantization unit configured to receive the spectrum parameter and the weighted coefficient and to quantize the spectrum parameter through search of the code vectors in the codebook so as to minimize a weighting distortion based on the weighted coefficient.

7. The speech parameter encoder according to claim 6, wherein the weighted coefficient calculation unit comprises:

a fourier transform unit for performing a fourier transform on the speech signal and to output a transformed speech signal as a result;

a power spectrum calculation unit coupled to the fourier transform unit and configured to calculate a power spectrum of the transformed speech signal and to output a power spectrum signal a result;

a critical band spectrum calculation unit coupled to the power spectrum calculation unit and configured to calculate a critical band spectrum power for each critical band of the power spectrum signal, wherein the power spectrum signal spans at least a plurality of critical bands in a frequency domain, each critical band being contiguous in frequency with an adjacent critical band, the critical band spectrum calculation unit further providing a convolution of the critical band spectrum power with a spreading function so as to generate a spreading signal as a result;

a masking threshold value spectrum calculation unit coupled to the critical band spectrum calculation unit and configured to compute a masking threshold value spectrum by multiplying the spreading signal with a masking threshold value and to determine a maximum of the multiplied result and an absolute threshold value so as to generate a masking threshold signal as a result; and a weighted coefficient unit coupled to the masking threshold value spectrum calculation unit and configured to derive the spectrum parameter by transformation of the masking threshold signal from a Burke axis to a Hertz axis.

* * * * *